US006999030B1

(12) United States Patent
Mateychuk

(10) Patent No.: US 6,999,030 B1
(45) Date of Patent: Feb. 14, 2006

(54) LINEAR POLARIZATION PLANAR MICROSTRIP ANTENNA ARRAY WITH CIRCULAR PATCH ELEMENTS AND CO-PLANAR ANNULAR SECTOR PARASITIC STRIPS

(75) Inventor: Duane E. Mateychuk, Westfield, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/974,277

(22) Filed: Oct. 27, 2004

(51) Int. Cl.
*H01Q 1/38* (2006.01)

(52) U.S. Cl. ..... 343/700 MS; 343/846

(58) Field of Classification Search ..... 343/700 MS, 343/702, 846, 848; H01Q 1/38
See application file for complete search history.

(56) References Cited

U.S. PATENT DOCUMENTS 4,554,549 A 11/1985 Fassett et al. ..... 343/700 MS
4,821,040 A * 4/1989 Johnson et al. ..... 343/700 MS
5,777,581 A * 7/1998 Lilly et al. ..... 343/700 MS
5,943,016 A * 8/1999 Snyder et al. ..... 343/700 MS
5,955,994 A * 9/1999 Staker et al. ..... 343/700 MS
6,061,025 A * 5/2000 Jackson et al. ..... 343/700 MS
6,788,257 B1 * 9/2004 Fang et al. ..... 343/700 MS

OTHER PUBLICATIONS

Zaiping Nie et al.; "Analysis of the Annular-Ring-Loaded Circular-Disk Microstrip Antenna"; *IEEE Transactions on Antennas and Propagation*; vol. 38, No. 6, Jun. 1990, pps 806-807.

* cited by examiner

*Primary Examiner*—Hoanganh Le
(74) *Attorney, Agent, or Firm*—Stefan V. Chmielewski

(57) ABSTRACT

A planar microstrip antenna includes one or more aperture-fed circular patch radiating elements capacitively coupled to respective parasitic strip elements. The circular patches are symmetrically disposed above respective ground plane apertures, and the parasitic strip elements are annular sectors that are co-planar and concentric with the circular patches, and placed adjacent to the periphery of each circular patch. The disclosed geometry enhances the input impedance bandwidth, and significantly reduces off-boresight radiation variability to provide beam directivity that is more uniform over both frequency and direction.

6 Claims, 2 Drawing Sheets

LINEAR POLARIZATION PLANAR MICROSTRIP ANTENNA ARRAY WITH CIRCULAR PATCH ELEMENTS AND CO-PLANAR ANNULAR SECTOR PARASITIC STRIPS

TECHNICAL FIELD

The present invention relates to a linear polarized planar microstrip radiating antenna element, and more particularly to a circular patch geometry that provides improved antenna element performance.

BACKGROUND OF THE INVENTION

Planar microstrip antenna elements and arrays are utilized in a variety of applications due to their simple structure, packaging advantages, and ease in fabrication and integration with associated electronic circuitry. However, planar microstrip antennas are inherently limited in input impedance bandwidth, which is a significant disadvantage in variable and wideband frequency applications, and particularly in spread-spectrum applications.

It is known that the input impedance bandwidth of planar microstrip antenna elements and arrays can be improved by aperture feeding the radiating elements. This can be accomplished by constructing the antenna element or array as a set of three vertically aligned metal layers separated by intervening dielectric layers. The center metal layer is used as the ground plane and the two outer metal layers are respectively etched to form a feed structure and one or more radiating patches, with energy being coupled from the feed structure to the radiating patches through corresponding apertures etched in the ground plane layer. It is also known that the bandwidth can be further enhanced, at least in the case of rectangular radiating patches, through the addition of rectangular parasitic metal strips at the non-resonant edges of the radiating patches. The parasitic strips are co-planar with the radiating patches and capacitively load the respective radiating patches to make their electrical impedance more uniform across the range of activation frequency. However, antenna elements incorporating these features are still bandwidth limited and tend to exhibit excessive off-boresight variation in beam directivity. Accordingly, what is needed is a linearly polarized planar microstrip antenna having both improved input impedance bandwidth and off-boresight radiation uniformity.

SUMMARY OF THE INVENTION

The present invention is directed to an improved planar microstrip antenna including one or more aperture-fed circular disk patch radiating elements capacitively coupled to respective parasitic strip elements. The circular disk patches are symmetrically disposed above respective ground plane apertures, and the parasitic strip elements are annular sectors that are co-planar and concentric with the circular disk patches, and placed adjacent to the periphery of each patch. This geometry provides further enhancement of the input impedance bandwidth, and significantly reduced off-boresight radiation variability, for beam directivity that is more uniform over both frequency and direction.

BRIEF DESCRIPTION OF THE DRAWINGS

The present invention will now be described, by way of example, with reference to the accompanying drawings, in which:—

DESCRIPTION OF THE PREFERRED EMBODIMENT

The present invention is illustrated herein in the context of a radar transceiver 10 designed for radar object detection in a motor vehicle back-up and parking aid. However, it should be understood that the present invention applies to planar microstrip antennas in general, regardless of application.

Figure 1:
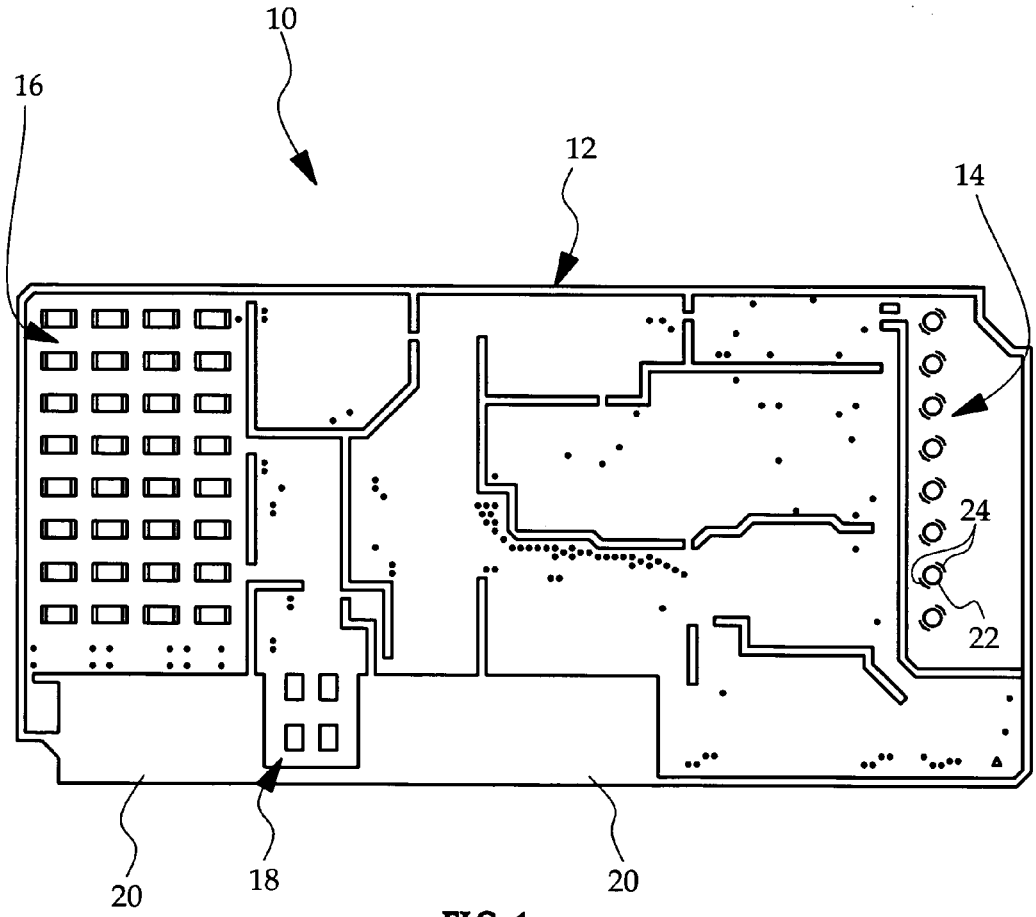
FIG. 1 depicts a multi-layer printed circuit board defining a planar microstrip transmitter antenna according to this invention, a first planar microstrip receiver antenna for long-range narrow-angle object detection, and a second planar receiver antenna for short-range wide-angle object detection.

Referring to FIG. 1, the transceiver 10 is constructed as a populated multi-layer circuit board 12. In usage, the circuit board 12 is mounted in a plastic housing, which in turn, is mounted on a vehicle bumper structure behind a plastic bumper covering or fascia. The field-of-view requirements in object detection applications are typically quite extensive, and are satisfied in the illustrated embodiment by equipping the transceiver 10 with one transmitter antenna 14 and a pair of receiver antennae 16, 18. The transmitter antenna 14 illuminates the entire field-of-view with radar energy; the receiver antenna 16 is responsive to long-range narrow-angle reflected energy, while the receiver antenna 18 is responsive to short-range wide-angle reflected energy. Additionally, the receiver antenna 16 includes vertical polarization elements in order to reduce background clutter and enhance detection of vertically oriented objects such as poles, and the receiver antenna 18 includes horizontal polarization elements in order to minimize wide-angle attenuation of the radar energy by the plastic bumper fascia. The transmitter antenna 14 is slant-polarized to create both vertical and horizontal reflected energy for the receiver antennae 16 and 18.

The transmitter antenna 14 is formed on the right-hand side of the circuit board 12 as viewed in FIG. 1, and receiver antennae 16 and 18 are formed on the left-hand side of the circuit board 12. A conductive ground plane, designated by the reference numerals 20 is disposed laterally or horizontally about the receiver antenna 18 to enhance wide-angle sensitivity. The antennae 14, 16, 18 are each defined by various vertically aligned conductor and dielectric features formed in different layers of the multi-layer circuit board 12. The layers, described below in respect to transmitter antenna 14, include a feed network, a set of apertures perpendicularly aligned with the respective feed network conductors, and a set of conductive microstrip patches whose resonance is vertically aligned with the respective apertures. As illustrated in FIG. 1, the antennae 16 and 18 both feature a conventional rectangular microstrip patch type construction, with rectangular parasitic strips, while the antenna 14 features a novel microstrip patch construction, with circular disk patches 22 and annular sector parasitic strips 24.

Figure 2A:
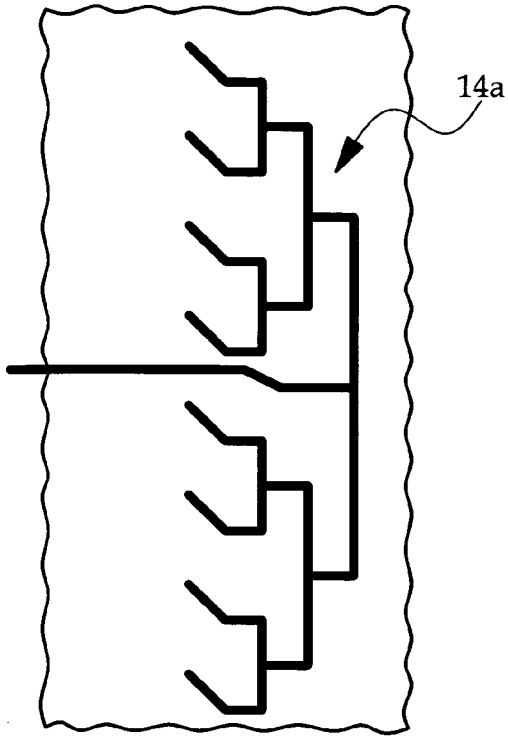
FIGS. 2A, 2B and 2C respectively depict first, second and third layers of the circuit board of FIG. 1 relative to the transmitter antenna.
Figure 2B:
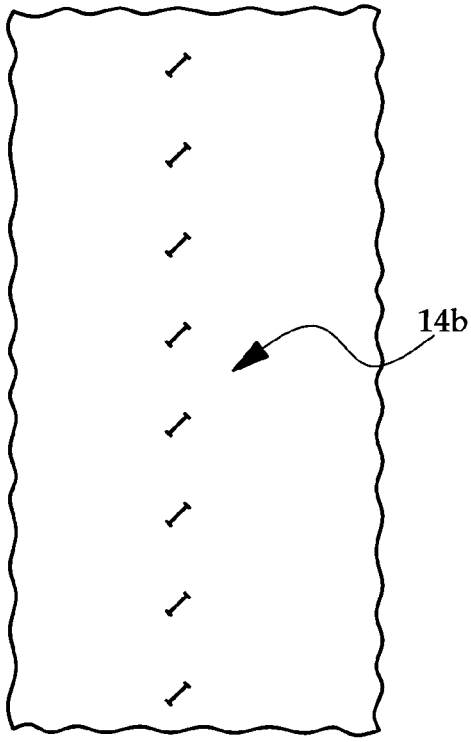
Figure 2C:
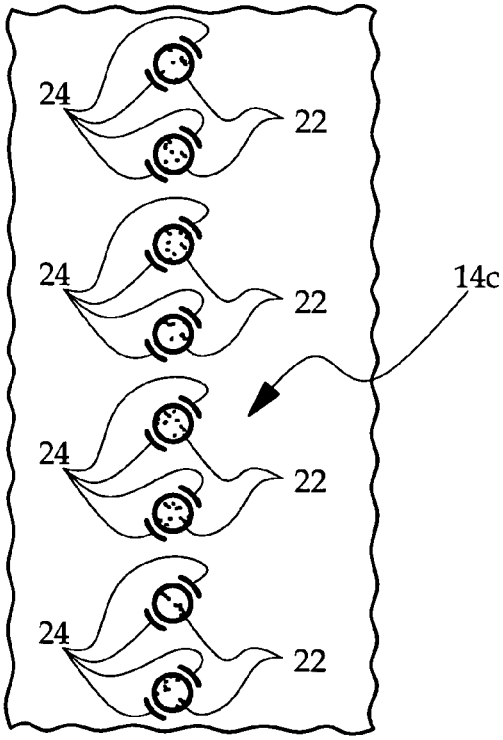
Figure 2D:
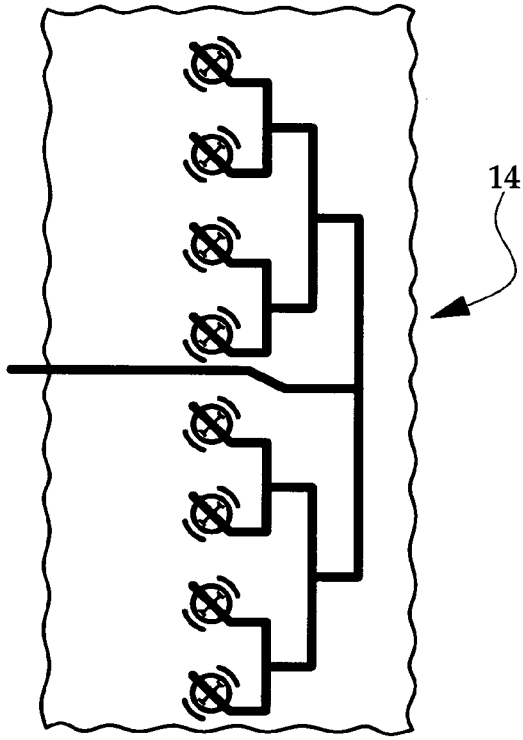
FIG. 2D depicts a composite of the first, second and third layers.

FIGS. 2A–2C depict the different individual layers of transmitter antenna 14, and FIG. 2D depicts the layers in composite. FIG. 2A depicts a feed network 14*a* comprising a conductor pattern formed on a first (bottom) layer of circuit board 12; FIG. 2B depicts a set of apertures 14*b* formed on a second (middle) layer of circuit board 12; and FIG. 2C depicts a set of antenna patches 14*c* and associated parasitic strips formed on the third (top) layer of circuit board 12. The feed network 14*a* is activated with continuous wave scanned frequency or spread-spectrum energy, which is coupled to the circular disk microstrip patches 22 through the respective apertures 14*b*. The annular sector parasitic strips 24 are located in the same magnetic field plane as the patches 22, with two annular sectors 24 oppositely disposed about each host circular patch 22 and centered about the slant polarization axis defined by the respective apertures 14*b*. The width and circumferential length of each annular sector 24 are selected so that the sectors 24 exhibit a resonant frequency similar to the resonant frequency of the host circular patch 22. In operation, each pair of parasitic strips 24 capacitively load the respective host patch 22 so that the electrical impedance of the patch array 14*c* is substantially consistent across the activation frequency bandwidth. This also enhances the radiation pattern bandwidth of the array 14*c*. As compared with a conventional rectangular patch antenna, the circular microstrip patch antenna of the present invention provides a more consistent gain across the field-of-view as well as enhanced operating bandwidth.

Summarizing, the microstrip antenna geometry of the present invention provides performance advantages compared to prior antenna constructs. It should be understood that various modifications in addition to those mentioned above will occur to those skilled in the art. For example, the number of annular sector strip pairs per host circular patch may be varied (i.e., multiple stagger-tuned annular sector parasitic pairs), the patches may be excited in a different way than shown (i.e., microstrip line fed, proximity coupled, probe-fed, etc.), and so on. Accordingly, it is intended that the invention not be limited to the disclosed embodiment, but that it have the full scope permitted by the language of the following claims.

What is claimed is:

1. A linearly polarized microstrip antenna, comprising:

a first planar metal layer defining:

at least one radiating element in the shape of a circular disk; and first and second parasitic strips, each in the shape of an annular sector, said parasitic strips being concentric with said radiating element and disposed adjacent an outer periphery of said radiating element, each said parasitic strip electromagnetically coupled with said radiating element.

2. The linearly polarized microstrip antenna of claim 1, further comprising:

second and third planar metal layers vertically aligned with said first planar layer, said third planar layer defining a feed element vertically aligned with said radiating element, and said second layer defining a ground plane having an aperture vertically aligned with said feed element and said radiating element.

3. The linearly polarized microstrip antenna of claim 2, wherein said first and second parasitic strips are disposed on a polarization axis defined by said aperture.

4. The linearly polarized microstrip antenna of claim 3, wherein said first and second parasitic strips are centered on said polarization axis.

5. The linearly polarized microstrip antenna of claim 1, wherein each of said first and second parasitic strips has a width dimension and a circumferential length dimension selected to exhibit a resonant frequency similar to a resonant frequency of said radiating element.

6. The linearly polarized microstrip antenna of claim 1, wherein said first planar metal layer defines an array of radiating elements, each in the shape of a circular disk, and a set of first and second parasitic strips for each radiating element, each parasitic strip having the shape of an annular sector, and each set of parasitic strips being concentric with a respective radiating element and disposed adjacent an outer periphery of such radiating element.

* * * * *